US010002583B2

(12) United States Patent
Xing et al.

(10) Patent No.: US 10,002,583 B2
(45) Date of Patent: Jun. 19, 2018

(54) DISPLAY DRIVE CIRCUIT AND DISPLAY PANEL

(71) Applicant: WUHAN CHINA STAR OPTOELECTRONICS TECHNOLOGY CO., LTD., Wuhan, Hubei (CN)

(72) Inventors: Zhenzhou Xing, Hubei (CN); Junxiao Zhang, Hubei (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 41 days.

(21) Appl. No.: 15/114,082

(22) PCT Filed: Apr. 8, 2016

(86) PCT No.: PCT/CN2016/078768
§ 371 (c)(1),
(2) Date: Jul. 26, 2016

(87) PCT Pub. No.: WO2017/156812
PCT Pub. Date: Sep. 21, 2017

(65) Prior Publication Data

US 2018/0012557 A1 Jan. 11, 2018

(30) Foreign Application Priority Data

Mar. 17, 2016 (CN) ..... 2016 1 0154053

(51) Int. Cl.
*G09G 3/36* (2006.01)

(52) U.S. Cl.
CPC ..... *G09G 3/3696* (2013.01); *G09G 2310/027* (2013.01); *G09G 2330/021* (2013.01)

(58) Field of Classification Search
CPC .. G09G 3/3696; G09G 3/3685; G09G 3/3688; G09G 3/3692; G09G 2310/027;
(Continued)

(56) References Cited

U.S. PATENT DOCUMENTS

2006/0097969 A1* 5/2006 Tsai ..... G09G 3/20 345/88
2007/0040855 A1 2/2007 Kato
(Continued)

FOREIGN PATENT DOCUMENTS

CN 101145322 A 3/2008
CN 102998858 A 3/2013
(Continued)

*Primary Examiner* — Tom Sheng
(74) *Attorney, Agent, or Firm* — Soroker Agmon Nordman

(57) ABSTRACT

A display drive circuit is provided, including a line buffer, a lever converter, a D/A converter, a Gamma reference voltage generator, and a buffer. The Gamma reference voltage generator has a first duty time and second duty time. In the first duty time, the Gamma reference voltage generator outputs the Gamma voltage to the buffer to charge pixel electrodes of a display having the display drive circuit. In the second duty time, the Gamma reference voltage generator outputs a common voltage to the buffer.

12 Claims, 2 Drawing Sheets

(58) Field of Classification Search
CPC ... G09G 2310/0272; G09G 2310/0275; G09G 2320/0276; G09G 2330/021
See application file for complete search history.

(56) References Cited

U.S. PATENT DOCUMENTS

| | | | | |
|---|---|---|---|---|
| 2008/0062110 | A1 | 3/2008 | Chang et al. | |
| 2009/0021507 | A1* | 1/2009 | Bae | G09G 3/3666 345/212 |
| 2010/0033413 | A1* | 2/2010 | Song | G09G 3/3655 345/89 |
| 2013/0127817 | A1* | 5/2013 | Hwang | G09G 3/001 345/212 |
| 2015/0194122 | A1* | 7/2015 | Kim | G09G 3/3614 345/99 |
| 2017/0069245 | A1 | 3/2017 | Xing et al. | |
| 2017/0140720 | A1 | 5/2017 | Guo et al. | |
| 2017/0148369 | A1* | 5/2017 | Park | G09G 3/2007 |

FOREIGN PATENT DOCUMENTS

| | | | |
|---|---|---|---|
| CN | 104809993 | A | 7/2015 |
| CN | 105070262 | A | 11/2015 |

* cited by examiner

DISPLAY DRIVE CIRCUIT AND DISPLAY PANEL

FIELD OF THE INVENTION

The present invention relates to the liquid display technology field, and in particular to a display drive circuit and a display panel.

BACKGROUND OF THE INVENTION

With the development of science and technology, people are increasingly demanding of display panels, such as high-resolution and true color, etc. In order to meet the needs of the users, the resolution of the existing mobile terminal with small and medium size display panels is continuously increased, the user can use the high-definition (HD) screen of the mobile terminal to play HD movies and display HD pictures.

However, since the resolution of the display panel is increased, the display pixels in the display panel are also increasing, charging power for the display drive circuit to charge the display pixel of the display panel is growing, resulting in a standby time of a battery of the mobile terminal with high resolution being short, and the needs of users thus cannot be satisfied.

Therefore, it is necessary to provide a display drive circuit and a display panel to solve the existing problems of the prior art.

SUMMARY OF THE INVENTION

In this way, the present invention provides a display drive circuit and a display panel with low power consumption and HD pictures support, in order to solve the technical problems of high power consumption or lack of HD pictures support.

An embodiment of the present invention provides a display drive circuit, used for driving a corresponding display panel to display a picture, including: a line buffer, used for receiving a video data signal; a Gamma reference voltage generator, used for generating a Gamma reference voltage corresponding to the video data signal; and a buffer, used for buffering the video data signal and the Gamma reference voltage to output to a data line of the display panel. The Gamma reference voltage generator has a first duty time and second duty time. In the first duty time, the Gamma reference voltage generator outputs the Gamma reference voltage to the buffer. In the second duty time, the Gamma reference voltage generator outputs a common voltage to the buffer. The first duty time is a charge time of charging a display pixel of the display panel, the second duty time is a non-charge time of the display pixel of the display panel. The display drive circuit further includes: a level converter, used for lifting a voltage of the video data signal; and a digital-analog converter, used for converting the video data signal lifted to an analog signal. The buffer is specifically used for buffering the Gamma reference voltage and the video data signal of the analog signal to output to the data line of the display panel.

In the display drive circuit of the present invention, the Gamma reference voltage generator generates the common voltage according to a voltage of a common line of the display panel, wherein the common voltage is outputted to the data line of the display panel.

In the display drive circuit of the present invention, the Gamma reference voltage generator generates the common voltage according to a voltage of a common line of a setting area of the display panel, the common voltage is outputted to a data line corresponding to the setting area of the display panel.

The embodiment of the present invention further provides a display drive circuit, used for driving a corresponding display panel to display a picture, including: a line buffer, used for receiving a video data signal; a Gamma reference voltage generator, used for generating a Gamma reference voltage corresponding to the video data signal; and a buffer, used for buffering the video data signal and the Gamma reference voltage to output to a data line of the display panel. The Gamma reference voltage generator has a first duty time and second duty time. In the first duty time, the Gamma reference voltage generator outputs the Gamma reference voltage to the buffer. In the second duty time, the Gamma reference voltage generator outputs a common voltage to the buffer.

In the display drive circuit of the present invention, the first duty time is a charge time of charging a display pixel of the display panel.

In the display drive circuit of the present invention, the second duty time is a non-charge time of the display pixel of the display panel.

In the display drive circuit of the present invention, the Gamma reference voltage generator generates the common voltage according to a voltage of a common line of the display panel, wherein the common voltage is outputted to the data line of the display panel.

In the display drive circuit of the present invention, the Gamma reference voltage generator generates the common voltage according to a voltage of a common line of a setting area of the display panel, the common voltage is outputted to a data line corresponding to the setting area of the display panel.

In the display drive circuit of the present invention, the display drive circuit further includes: a level converter, used for lifting a voltage of the video data signal; and a digital-analog converter, used for converting the video data signal lifted to an analog signal. The buffer is specifically used for buffering the Gamma reference voltage and the video data signal of the analog signal to output to the data line of the display panel.

The embodiment of the present invention further provides a display panel, including data lines, scan lines, common lines, a display drive circuit, and display pixels formed by the data lines and the scan lines interlaced. The display drive circuit includes: a line buffer, used for receiving a video data signal; a Gamma reference voltage generator, used for generating a Gamma reference voltage corresponding to the video data signal; and a buffer, used for buffering the video data signal and the Gamma reference voltage to output to a data line of the display panel. The Gamma reference voltage generator has a first duty time and second duty time. In the first duty time, the Gamma reference voltage generator outputs the Gamma reference voltage to the buffer. In the second duty time, the Gamma reference voltage generator outputs a common voltage to the buffer.

In the display panel of the present invention, the first duty time is a charge time of charging a display pixel of the display panel.

In the display panel of the present invention, the second duly time is a non-charge time of the display pixel of the display panel.

In the display panel of the present invention, the Gamma reference voltage generator generates the common voltage according to a voltage of a common line of the display panel, wherein the common voltage is outputted to the data line of the display panel.

In the display panel of the present invention, the Gamma reference voltage generator generates the common voltage according, to a voltage of a common line of a setting area of the display panel, the common voltage is outputted to a data line corresponding to the setting area of the display panel.

In the display panel of the present invention, the display drive circuit further includes: a level converter, used for lifting a voltage of the video data signal; and, a digital-analog converter, used for convening the video data signal lifted to an analog signal. The buffer is specifically used for buffering the Gamma a reference voltage and the video data signal of the analog signal to output to the data line of the display panel.

The display drive circuit and the display panel of the present invention dispose the different Gamma reference voltages generated by the Gamma reference voltage generator in different duty times to support the HD picture and to reduce the whole power consumption; the technical problems of higher power consumption or lack of HD pictures support of the existing display drive circuit and display panel are solved.

BRIEF DESCRIPTION OF THE DRAWINGS

The accompanying drawings are included to provide a further understanding of the invention, and are incorporated in and constitute a part of this specification. The drawings illustrate embodiments of the invention, together with the description, serve to explain the principles of the invention.

DETAILED DESCRIPTION OF THE PREFERRED EMBODIMENTS

Figure 1:
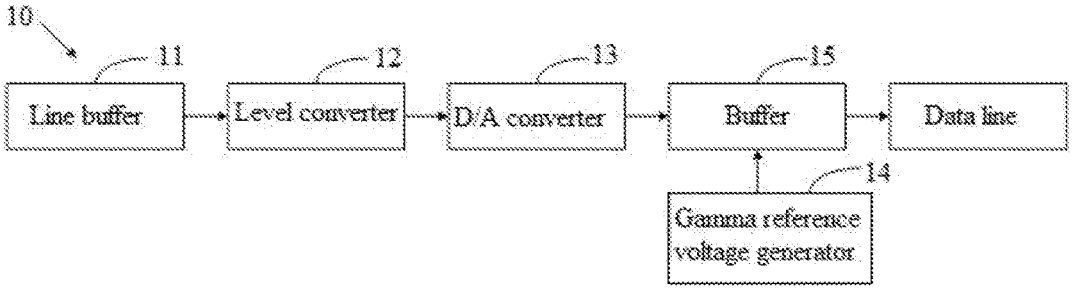
FIG. 1 illustrates a block diagram of a display drive circuit according to a preferred embodiment of the present invention.

As used in this specification the term "embodiment" means an instance, an example, or illustration. In addition, for the articles in this specification and the appended claims, "a" or "an" in general can be interpreted as "one or more" unless specified otherwise or clear from context to determine the singular form.

In the drawings, the same reference numerals denote units with similar structures.

Please refer to FIG. 1, which illustrates a block diagram of a display drive circuit according to a preferred embodiment of the present invention. The display drive circuit 10 includes a line buffer 11, a level converter 12, a digital-analog converter 13, a Gamma reference voltage generator 14, and a buffer 15.

The line buffer 11 is used for receiving a video data signal. The level converter 12 is used for lifting a voltage of the video data signal. The digital-analog converter 13 is used for converting the video data signal lifted to an analog signal. The Gamma reference voltage generator 14 is used for generating a Gamma reference voltage corresponding to the video data signal. The buffer 15 is used for buffering the video data signal and the Gamma reference voltage to output to a data line of the display panel.

The Gamma reference voltage generator 14 has a first duty time and a second duty time. The first duty time is a charge time of charging a display pixel of the display panel, while the second duty time is a non-charge time of the display pixel of the display panel.

In the first duly time, the Gamma reference voltage generator 14 outputs the Gamma reference voltage to the buffer 15; in the second duty time, the Gamma reference voltage generator 14 outputs a common voltage to the buffer 15.

When the display drive circuit 10 of the preferred embodiment is used, the line buffer 11 (Line Buffer) receives the external video data signal tint, then the level converter 12 (Level Shifter) lifts a voltage of the received video data signal. Then the lifted video data signal is converted to an analog signal through the digital-analog converter 13 (D/A Converter), in order to drive the display pixel.

While the video data signal is inputted to the digital-analog converter 13, the Gamma reference voltage generator 14 generates a Gamma reference voltage corresponding to the video data signal, and transmits the Gamma reference voltage to the buffer 15 by the Gamma reference voltage generator 14. The video data signal of the digital-analog converter 13 is also transmitted to the buffer 15. The buffer 15 buffers the video data signal and the corresponding Gamma reference voltage, in order to output them to the data line of the display panel, and thus display the picture.

Figure 2:
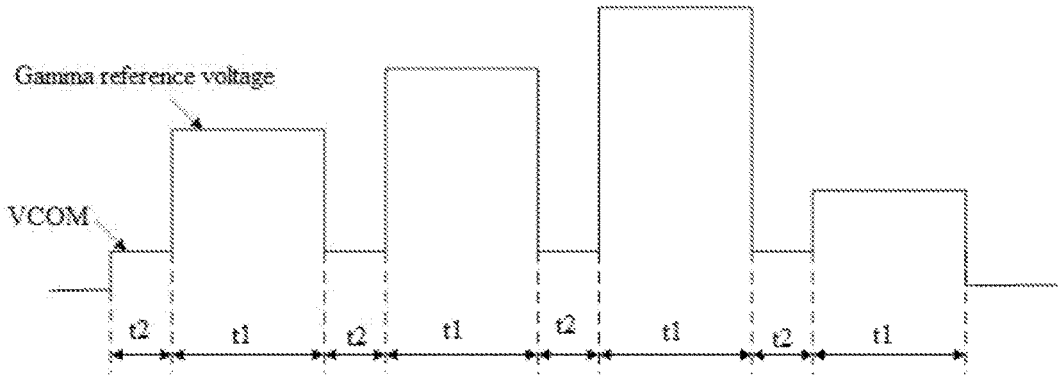
FIG. 2 illustrates a waveform diagram of an output signal of a Gamma reference voltage generator of the display drive circuit according to a preferred embodiment of the present invention.

Please refer to FIG. 2, because the display pixels of the display panel are scanned (charged) line by line, the time that the display, pixels of a respective line of the display panel are scanned (charged) corresponding to a first duty time of the Gamma reference voltage generator 14. A time interval between two adjacent hues being scanned corresponds to a second duty time of the Gamma reference voltage generator 14.

The Gamma reference voltage generator 14 of the display drive circuit 10 of the preferred embodiment outputs the Gamma reference voltage to the buffer 15 in the first duty time t1, then coordinates with the video data signal to perform the line scanning to the display pixel of the display panel.

The Gamma reference voltage generator 14 outputs a common voltage to the buffer 15 in the second duty time t2, then outputs the common voltage to a pixel electrode of the display pixel of the display panel through the data line, wherein the voltages applied to the pixel electrode and a common electrode (connected with a common line) of the display pixel are both common voltage. Meanwhile, the voltage difference between two ends of a liquid crystal layer of the display panel is zero; thus, no loss of the power consumption of the display panel happens; and at the same time, the Gamma reference voltage generator 14 does not need to output the Gamma reference voltage in the second duty time t2, the loss of the power consumption Gamma reference voltage generator 14 is further reduced, and the power consumption is successfully saved.

Figure 3:
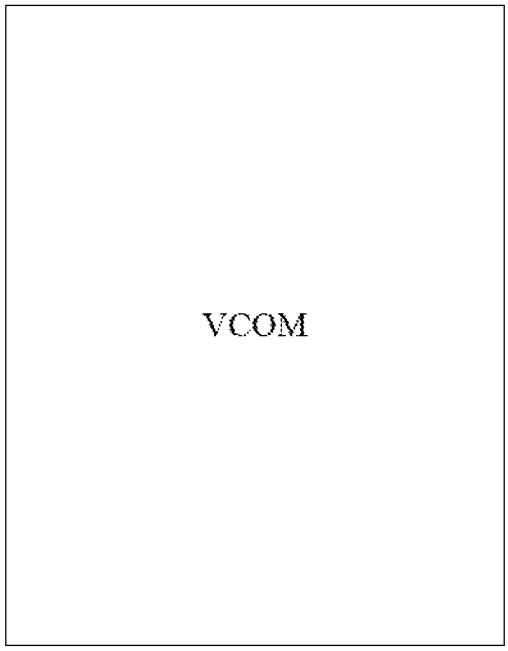
FIG. 3 illustrates a diagram of an outputted common voltage of the Gamma reference voltage generator of the display drive circuit according to a preferred embodiment of the present invention.

Preferably, the Gamma reference voltage generator 14 can generate the common voltage according to a voltage of a common line of the display panel, wherein the common voltage is outputted to the data line of the display panel, to ensure the voltage difference between two ends of the liquid crystal layer to be zero. Specifically, as shown in FIG. 3 here, the Gamma reference voltage generator 14 acquires the voltage VCOM of the common line of the display panel. When there is a plurality of different common lines, an average value of the voltages of the different common lines can be first obtained. Then the common voltage of the Gamma reference voltage generator 14 is generated according to the average voltage of the voltages of the common lines.

Figure 4:
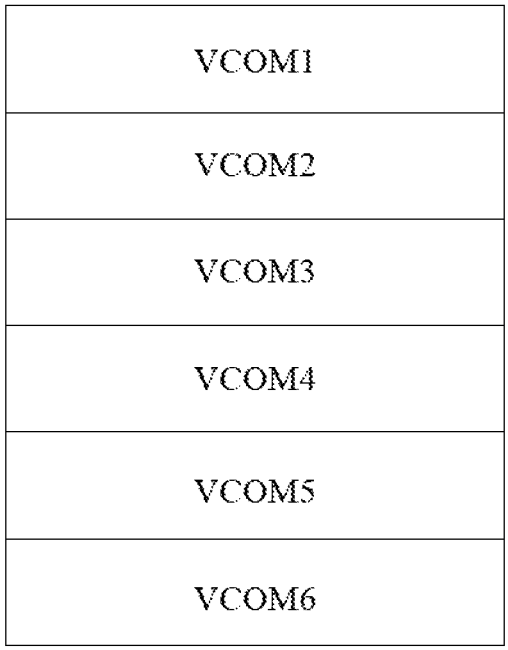
FIG. 4 illustrates another diagram of an outputted common voltage of the Gamma reference voltage generator of the display drive circuit according to a preferred embodiment of the present invention.

Preferably, the Gamma reference voltage generator 14 can generate the common voltage according to a voltage of a common line of a setting area of the display panel, to ensure the voltage difference between two ends of the liquid crystal layer to be zero. Specifically, as shown in FIG. 4 here, the display panel is divided to 6 setting areas, each of the voltages of the 6 setting areas is VCOM1, VCOM2, VCOM3, VCOM4, VCOM5, and VCOM6, respectively, wherein the 6 voltages can be the same or not. The Gamma reference voltage generator 14 here can generate 6 corresponding common voltages according to the voltages of the common lines of the 6 setting areas respectively, in order to make the common voltage on the pixel electrode match the voltage of the common electrode better, and further save the power consumption of the display of the display panel.

The display drive circuit of the preferred embodiment disposes the different Gamma reference voltages generated by the Gamma reference voltage generator in different duty times, to support the HD picture, and reduce the whole power consumption.

The present invention further provides a display panel, the display panel includes data lines, scan lines, common lines, a display drive circuit, and display pixels formed by the data lines and the scan lines interlaced. The display drive circuit includes a line buffer, a level converter, a digital-analog converter, a Gamma reference voltage generator, and a buffer.

The line buffer is used for receiving a video data signal. The level converter is used for lifting a voltage of the video data signal. The digital-analog converter is used for converting the lifted video data signal to an analog signal. The Gamma reference voltage generator is used for generating a Gamma reference voltage corresponding to the video data signal. The buffer is used for buffering the video data signal and Gamma reference voltage, to output to the data line of the display panel.

The Gamma reference voltage generator has a first duty time and a second duty time. In the first duty time, the Gamma reference voltage generator outputs the Gamma reference voltage to the buffer; in the second duty time, the Gamma reference voltage generator outputs a common voltage to the buffer.

Preferably, the first duty time is a charge time of the display pixel of the display panel, the second duty time is a non-charge time of the display pixel of the display panel.

Preferably, the Gamma reference voltage generator generates the common voltage according to a voltage of a common line of the display panel, wherein the common voltage is outputted to the data line of the display panel Preferably, the Gamma reference voltage generator generates the common voltage according to a voltage of a common line of a setting area of the display panel, the common voltage is outputted to, a data line corresponding to the setting area of the display panel.

The display drive circuit and the display panel of the present invention set the Gamma reference voltage generator to generate the different Gamma reference voltages in different duty times to support the HD picture and to reduce the whole power consumption; the technical problems of higher power consumption or lack of HD picture support of the existing display drive circuit and display panel are solved.

In summary, although the present invention has been described in preferred embodiments above, the preferred embodiments described above are not intended to limit the invention. Persons skilled in the art, without departing from the spirit and scope of the invention otherwise, may be used for a variety modifications and variations, so the scope of the invention as defined by the claims prevails.

What is claimed is:

1. A display drive circuit, used for driving a corresponding display panel to display a picture, comprising:

a line buffer, used for receiving a video data signal;

a Gamma reference voltage generator, used for generating a Gamma reference voltage corresponding to the video data signal; and a buffer, used for buffering the video data signal and the Gamma reference voltage to output to a data line of the display panel;

wherein the Gamma reference voltage generator has a first duty time and second duty time, in the first duty time, the Gamma reference voltage generator outputs the Gamma reference voltage to the buffer; in the second duty time, the Gamma reference voltage generator outputs a common voltage to the buffer; wherein the Gamma reference voltage generator generates the common voltage according to a voltage of a common line of the display panel, wherein the common voltage is outputted to the data line of the display panel;

wherein the first duty time is a charge time of charging a display pixel of the display panel, the second duty time is a non-charge time of the display pixel of the display panel;

wherein the display drive circuit further comprises:

a level converter, used for lifting a voltage of the video data signal; and a digital-analog converter, used for converting the video data signal lifted to an analog signal;

wherein the buffer is used for buffering the Gamma reference voltage and the video data signal of the analog signal to output to the data line of the display panel.

2. The display drive circuit of claim 1, wherein the Gamma reference voltage generator generates the common voltage according to a voltage of a common line of a setting area of the display panel, the common voltage is outputted to a data line corresponding to the setting area of the display panel.

3. A display drive circuit, used for driving a corresponding display panel to display a picture, comprising:

a line buffer, used for receiving a video data signal;

a Gamma reference voltage generator, used for generating a Gamma reference voltage corresponding to the video data signal; and a buffer, used for buffering the video data signal and the Gamma reference voltage to output to a data line of the display panel;

wherein the Gamma reference voltage generator has a first duty time and second duty time, in the first duty time, the Gamma reference voltage generator outputs the Gamma reference voltage to the buffer; in the second duty time, the Gamma reference voltage generator outputs a common voltage to the buffer; wherein the Gamma reference voltage generator generates the common voltage according to a voltage of a common line of the display panel, wherein the common voltage is outputted to the data line of the display panel.

4. The display drive circuit of claim 3, wherein the first duty time is a charge time of charging a display pixel of the display panel.

5. The display drive circuit of claim 3, wherein the second duty time is a non-charge time of the display pixel of the display panel.

6. The display drive circuit of claim 3, wherein the Gamma reference voltage generator generates the common voltage according to a voltage of a common line of a setting area of the display panel, the common voltage is outputted to a data line corresponding to the setting area of the display panel.

7. The display drive circuit of claim 3, wherein the display drive circuit further comprises:

a level converter, used for lifting a voltage of the video data signal; and a digital-analog converter, used for converting the video data signal lifted to an analog signal;

wherein the buffer is used for buffering the Gamma reference voltage and the video data signal of the analog signal to output to the data line of the display panel.

8. A display panel, comprising data lines, scan lines, common lines, a display drive circuit and display pixels formed by the data tines and the scan lines interlaced;

wherein the display drive circuit comprises:

a line buffer, used for receiving a video data signal;

a Gamma reference voltage generator, used for generating a Gamma reference voltage corresponding to the video data signal; and a buffer, used for buffering the video data signal and the Gamma reference voltage to output to a data line of the display panel;

wherein the Gamma reference voltage generator has a first duty time and second duty time, in the first duty time, the Gamma reference voltage generator outputs the Gamma reference voltage to the buffer; in the second duty time, the Gamma reference voltage generator outputs a common voltage to the buffer; wherein the Gamma reference voltage generator generates the common voltage according to a voltage of a common line of the display panel, wherein the common voltage is outputted to the data line of the display panel.

9. The display panel of claim 8, wherein the first duty time is a charge time of charging a display pixel of the display panel.

10. The display panel of claim 8, wherein the second duty time is a non-charge time of the display pixel of the display panel.

11. The display panel of claim 8, wherein the Gamma reference voltage generator generates the common voltage according to a voltage of a common line of a setting area of the display panel, the common voltage is outputted to a data line corresponding to the setting area of the display panel.

12. The display panel of claim 8, wherein the display drive circuit further comprises:

a level converter, used for lifting a voltage of the video data signal; and, a digital-analog converter, used for converting the video data signal lifted to an analog signal;

wherein the buffer is used for buffering the Gamma reference voltage and the video data signal of the analog signal to output to the data line of the display panel.

* * * * *